United States Patent [19]

Speil

[11] Patent Number: 4,716,867

[45] Date of Patent: Jan. 5, 1988

[54] INNER ELEMENT FOR A HYDRAULIC VALUE COMPENSATION ELEMENT

[75] Inventor: Walter Speil, Ingolstadt, Fed. Rep. of Germany

[73] Assignee: Motomak Motorenbau, Maschinen- und Werkzeugfabrik, Konstruktionen GmbH, Fed. Rep. of Germany

[21] Appl. No.: 17,761

[22] Filed: Feb. 20, 1987

[30] Foreign Application Priority Data

Feb. 28, 1986 [DE] Fed. Rep. of Germany ..... 3606536

[51] Int. Cl.[4] ..... F01L 1/24

[52] U.S. Cl. ..... 123/90.55; 123/90.46

[58] Field of Search ..... 123/90.55, 90.56, 90.57, 123/90.58, 90.59, 90.46, 90.43

[56] References Cited

U.S. PATENT DOCUMENTS

| | | | |
|---|---|---|---|
| 2,941,523 | 6/1960 | Bergmann | 123/90.55 |
| 3,358,660 | 12/1967 | Cornell | 123/90.55 |
| 3,516,393 | 6/1970 | Dadd | 123/90.55 |
| 4,227,495 | 10/1980 | Krieg | 123/90.55 |
| 4,502,428 | 3/1985 | Paar | 123/90.46 |
| 4,621,598 | 11/1986 | Miura | 123/90.55 |
| 4,644,913 | 2/1987 | Stoody | 123/90.55 |
| 4,644,914 | 2/1987 | Morita et al. | 123/90.55 |

FOREIGN PATENT DOCUMENTS

| | | | |
|---|---|---|---|
| 150914 | 8/1984 | Japan | 123/90.55 |
| 206914 | 10/1985 | Japan | 123/90.55 |

*Primary Examiner*—Ira S. Lazarus

*Attorney, Agent, or Firm*—Bierman & Muserlian

[57] ABSTRACT

An inner element for the hydraulic valve clearance compensation element for an internal combustion engine comprising a cylindrical element (3) closed on one end and a piston element (5) guided therein for longitudinal displacement and protruding beyond the open end of cylindrical element (3), the piston element (5) having a reduced outer diameter (6) in its protruding portion engaging a radial flange (10) of a restraining element (9) held by a collar (11) on the open end of cylindrical element (3), the open end of element (3) having also a reduced outer diameter (7) with an additional diameter reduction in the form of peripheral groove (8) engaging positively the collar (11) of the restraining element (9) at at least some peripheral points, the restraining element (9) having one projection (13) at at least one peripheral point radially protruding beyond the outer diameter of cylindrical element (3), characterized in that the collar (11) of restraining element (9) is provided in its initial stage at its end opposite to the radial flange (10) with an outer diameter (13) greater than the outer diameter of cylindrical element (3) in which area at least two indentations spaced about the circumference are provided at which the restraining element material is shaped into the peripheral groove (8) of the cylindrical element (3).

1 Claim, 3 Drawing Figures

INNER ELEMENT FOR A HYDRAULIC VALUE COMPENSATION ELEMENT

STATE OF THE ART

Inner elements for hydraulic valve clearance compensation elements for internal combustion engines are known wherein a cylindrical element is closed on one end and a piston element guided therein for longitudinal displacement protrudes from the open end of the cylindrical element and has a reduced outer diameter in the protruding area which engages a radial flange of a restraining element engaging a collar on the open end of the cylindrical element which has also a reduced outer diameter with an additional diameter reduction in the form of a peripheral groove engaging positively the collar of the restraining element at at least several peripheral points, the restraining element having one projection at at least on peripheral point a projection radially protruding beyond the outer diameter of the cylindrical element. Such elements are inserted into the bores of rocker arms or valve lifters with which they cooperate.

To prevent the inner elements from sliding out of the bores into which they are inserted before the entire hydraulic valve clearance compensation element is permanently installed the projection radially protruding beyond the outer diameter of cylindrical element engages a diameter enlargement of the bore in which the inner element is inserted. Such a diameter enlargement of the bore does not have to be produced separately because it is provided during normal machining operation at the end of the bore to permit the removal of the machining tool.

When securing the restraining element at the end of the cylindrical element, the collar must be conformed into the peripheral groove with a radially acting stamping tool at several peripheral points and in the known construction, this requires a separate alignment step to prevent the stamping tools from engaging the points where the radial projections which protrude beyond the outer diameter of the cylindrical element are provided. Only by this step does one avoid damaging the projections or rendering them entirely inoperative during the stamping operation.

OBJECTS OF THE INVENTION

It is an object of the invention to provide a novel construction for securing the restraining element to the cylindrical element in a simple manner without a separate alignment step.

This and other objects and advantages of the invention will become obvious from the following detailed description.

THE INVENTION

The novel inner element of the invention for the hydraulic valve clearance compensation element for an internal combustion engine comprises a cylindrical element (3) closed on one end and a piston element (5) guided therein for longitudinal displacement and protruding beyond the open end of cylindrical element (3), the piston element (5) having a reduced outer diameter (6) in its protruding portion engaging a radial flange (10) of a restraining element (9) held by a collar (11) on the open end of cylindrical element (3), the open end of element (3) having also a reduced outer diameter (7) with an additional diameter reduction in the form of peripheral groove (8) engaging positively the collar (11) of the restraining element (9) at at least some peripheral points, the restraining element (9) having one projection (13) at at least one peripheral point radially protruding beyond the outer diameter of cylindrical element (3), characterized in that the collar (11) of restraining element (9) is provided in its initial stage at its end opposite to the radial flange (10) with an outer diameter (13) greater than the outer diameter of cylindrical element (3) in which area at least two indentations spaced about the circumference are provided at which the restraining element material is shaped into the peripheral groove (8) of the cylindrical element (3).

Referring now to the drawings

Figure 1:
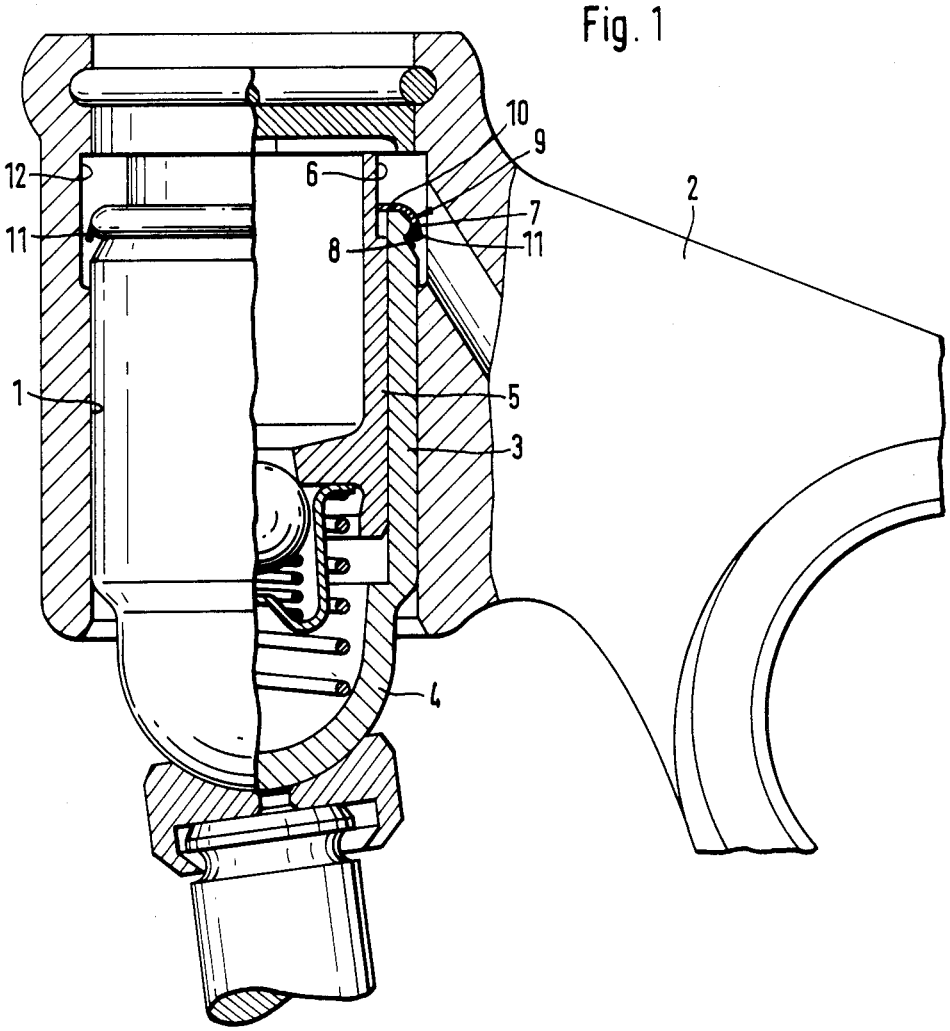
FIG. 1 is a cross-section of an inner element of the invention inserted into a bore of a rocker arm.

In FIG. 1, the inner element is inserted into bore 1 of a rocker arm 2 and consists of cylindrical element 3 with a closed end 4 and piston element 5 longitudinally guided therein. Piston element 5 contains a known check valve and a helical spring is placed between the piston element and cylindrical element which urges the two elements apart. Piston element 5 protrudes from the open end of cylindrical element 3 and has a reduced outer diameter 6 in this area. Cylindrical element 3 is provided at the open end with reduced outer diameter 7 in the area of which a peripheral groove 8 is additionally provided.

A restraining element 9 is placed on the reduced end 7 of cylindrical element 3 and engages by radial flange 10 the reduced diameter area 6 of the piston element to prevent the piston element 5 from sliding out of the cylindrical element 3. At several peripheral points on the cylindrical collar 11 of restraining element 9 which is forced into groove 8 for retention of the restraining element are projections 17 protruding beyond the outer diameter of cylindrical element 3 while engaging diameter enlargement 12 at the end of bore 1 of the rocker arm 2. The projections 13 prevent the entire inner element from sliding out of bore 1.

Figure 2:
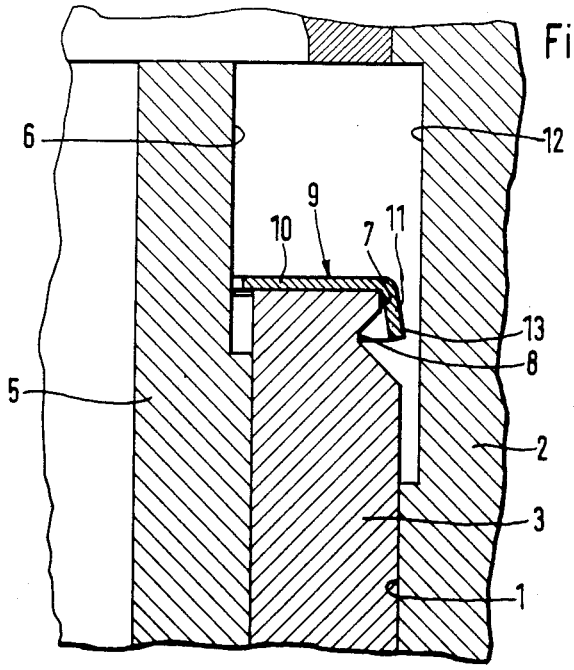
FIG. 2 is an enlarged partial cross-sectional view of the restraining element placed on the cylindrical element in its initial state.

The enlarged detail of FIG. 2 shows the restraining element 9 in its initial state with radial flange 10 and projections 13.

Figure 3:
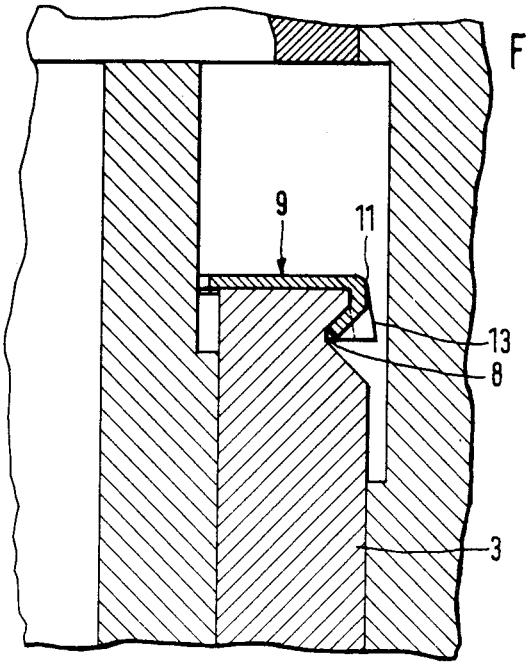
FIG. 3 is an enlarged cross-sectional partial view of the same restraining element after it has been secured to the cylindrical element.

As can be seen from FIG. 3, the projections 13 are shaped radially inwardly at several peripheral areas by embossing dies to engage the peripheral groove 8 in a form-fitting manner. The inbetween areas of the collar keep their original position and define the restraining projections which cooperate with the enlargement 12 of the diameter of the bore 1.

It should be understood that the placing of the restraining element 9 on the cylindrical element 3 and its attachment thereto is effected before the inner element is inserted into bore 1 of the rocker arm 2. In FIG. 2, the inner element is shown as if it had already been inserted into bore 1 only to indicate how projections 13 cooperate with the diameter enlargement 12 of bore 1.

Various modifications of the inner elements of the invention may be made without departing from the spirit or scope thereof and it is to be understood that the invention is intended to be limited only as defined in the appended claims.

What I claim is:

1. An inner element for the hydraulic valve clearance compensation element for an internal combustion engine comprising a cylindrical element (3) closed on one end and a piston element (5) guided therein for longitudinal displacement and protruding beyond the open end of cylindrical element (3), the piston element (5) having a reduced outer diameter (6) in its protruding portion engaging a radial flange (10) of a restraining element (9) held by a collar (11) on the open end of cylindrical element (3), the open end of element (3) having also a reduced outer diameter (7) with an additional diameter reduction in the form of peripheral groove (8) engaging positively the collar (11) of the restraining element (9), at at least some peripheral points, the restraining element (9) having one projection (13) at at least one peripheral point radially protruding beyond the outer diameter of cylindrical element (3), characterized in that the collar (11) of restraining element (9) is provided in its initial stage at its end opposite to the radial flange (10) with an outer diameter (13) greater than the outer diameter of cylindrical element (3) in which area at least two indentations spaced about the circumference are provided at which the restraining element material is shaped into the peripheral groove (8) of the cylindrical element (3).

* * * * *